US006128593A

United States Patent [19]

Hu

[11] Patent Number: 6,128,593

[45] Date of Patent: Oct. 3, 2000

[54] SYSTEM AND METHOD FOR IMPLEMENTING A REFINED PSYCHO-ACOUSTIC MODELER

[75] Inventor: Fengduo Hu, Milpitas, Calif.

[73] Assignees: Sony Corporation, Tokyo, Japan; Sony Electronics Inc., Park Ridge, N.J.

[21] Appl. No.: 09/128,924

[22] Filed: Aug. 4, 1998

[51] Int. Cl.[7] ..... G10L 21/00

[52] U.S. Cl. ..... 704/229; 704/230

[58] Field of Search ..... 704/229, 230, 704/200, 201, 212, 224, 225

[56] References Cited

U.S. PATENT DOCUMENTS

| | | | |
|---|---|---|---|
| 5,402,124 | 3/1995 | Todd et al. | 341/131 |
| 5,623,577 | 4/1997 | Fielder | 704/229 |
| 5,627,938 | 5/1997 | Johnston | 704/230 |
| 5,632,003 | 5/1997 | Davidson et al. | 704/229 |
| 5,646,961 | 7/1997 | Shoham et al. | 375/243 |
| 5,649,053 | 7/1997 | Kim | 704/229 |
| 5,794,188 | 8/1998 | Hollier | 704/228 |
| 5,799,270 | 8/1998 | Hasegawa | 704/205 |

OTHER PUBLICATIONS

Electronics & Communications Engineering Journal. Ambikairajah et al., "Auditory masking and MPEG–1 audio compression", Aug. 1997, pp. 165–175.

*Primary Examiner*—Richemond Dorvil

*Attorney, Agent, or Firm*—Gregory J. Koerner; Simon & Koerner LLP

[57] ABSTRACT

A system comprises a refined psycho-acoustic modeler for efficient perceptive encoding compression of digital audio. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity. The present invention includes a refined approximation to the experimentally derived individual masking spread function, which allows superior performance when used to calculate the overall amplitudes and frequencies that may be ignored. The present invention also includes an enhanced tonal component determiner, which allows for the more accurate identification of significant tonal components.

41 Claims, 10 Drawing Sheets

SYSTEM AND METHOD FOR IMPLEMENTING A REFINED PSYCHO-ACOUSTIC MODELER

BACKGROUND OF THE INVENTION

1. Field of the Invention

This invention relates generally to improvements in digital audio processing and specifically to a system and method for implementing a refined psycho-acoustic modeler in digital audio encoding.

2. Description of the Background Art

Digital audio is now in widespread use in audio and audiovisual systems. Digital audio is used in compact disk (CD) players, digital video disk (DVD) players, digital video broadcast (DVB), and many other current and planned systems. A problem in all of these systems is the limitation of either storage capacity or bandwidth, which may be viewed as two aspects of a common problem. In order to fit more digital audio in a storage device of limited storage capacity, or to transmit digital audio over a channel of limited bandwidth, some form of digital audio compression is required.

Because of the structure of digital audio, many of the traditional data compression schemes have been shown to yield poor results. One data compression method that does work well with digital audio is perceptive encoding. Perceptive encoding uses experimentally determined information about human hearing from what is called psycho-acoustic theory. The human ear does not perceive sound frequencies evenly. It has been determined that there are 25 non-linearly spaced frequency bands, called critical bands, to which the ear responds. Furthermore, it has been shown experimentally that the human ear cannot perceive tones whose amplitude is below a frequency-dependent threshold, or tones that are near in frequency to another, stronger tone. Perceptive encoding exploits these effects by first converting digital audio from the time-sampled domain to the frequency-sampled domain, and then by not allocating data to those sounds which would not be perceived by the human ear. In this manner, digital audio may be compressed without the listener being aware of the compression. The system component that determines which sounds in the incoming digital audio stream may be safely ignored is called a psycho-acoustic modeler.

A common example of perceptive encoding of digital audio is that given by the Motion Picture Experts Group (MPEG) in their audio and video specifications. A standard decoder design for digital audio is given in the MPEG specifications, which allows all MPEG encoded digital audio to be reproduced by differing vendors' equipment. Certain parts of the encoder design must also be standard in order that the encoded digital audio may be reproduced with the standard decoder design. However, the psycho-acoustic modeler may be changed without affecting the ability of the resulting encoded digital audio to be reproduced with the standard decoder design.

Early consumer products using MPEG standards, such as DVD players, were playback-only devices. The encoding was left to professional studio mastering facilities, where shortcomings in the psycho-acoustic modeler could be overcome by making numerous attempts at encoding and adjusting the equipment until the resulting encoded digital audio was satisfactory. Moreover the cost of the encoding equipment to a recording studio was not a substantial issue. These factors will no longer be true when newer consumer products, such as recordable DVD players and DVD camcorders, become available. The consumer will want to make a satisfactory recording with a single attempt, and the cost of the encoding equipment will be a substantial issue. Therefore, there exists a need for a refined psycho-acoustic modeler for use in consumer digital audio products.

SUMMARY OF THE INVENTION

The present invention includes a system and method for a refined psycho-acoustic modeler in digital audio encoding. In the preferred embodiment, the present invention comprises an enhanced psycho-acoustic modeler for efficient perceptive encoding compression of digital audio. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity.

The present invention includes a refined approximation to the experimentally-derived individual masking spread function, which allows superior performance when used to calculate the overall amplitudes and frequencies which may be ignored during compression. The present invention may be used whether the maskers are tones or noise. The upper segment of the piecewise linear approximation to the experimentally-derived spread function has a slope of −7 dB/Bark when the masker has a sound pressure level (SPL) of 80 dB, a slope of −10 dB/Bark when the masker has a SPL of 60 dB, and a slope of−14 dB/Bark when the masker has a SPL of 40 dB. The piecewise linear spread function has an offset from the amplitude of the masker given by a mask index. The mask index has an initial offset of between 3 dB and 4 dB when the masker is a noise component, and a slope of −0.3 dB/Bark. When the masker is a tonal component, the mask index has a slope of −0.35 dB/Bark.

The present invention also includes an enhanced tonal component determiner, which allows for the more accurate identification of significant tonal components. The number of neighboring samples tested is reduced when compared with a traditional tonal component determiner.

DETAILED DESCRIPTION OF THE PREFERRED EMBODIMENT

The present invention relates to an improvement in digital signal processing. The following description is presented to enable one of ordinary skill in the art to make and use the invention and is provided in the context of a patent application and its requirements. The present invention is specifically disclosed in the environment of digital audio perceptive encoding in Motion Picture Experts Group (MPEG) format, performed in a encoder/decoder (CODEC) integrated circuit. However, the present invention may be practiced wherever the necessity for psycho-acoustic modeling in perceptive encoding occurs. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

In the preferred embodiment, the present invention comprises an enhanced psycho-acoustic modeler for efficient perceptive encoding compression of digital audio. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity. The present invention includes a refined approximation to the experimentally derived individual masking spread function, which allows superior performance when used to calculate the overall amplitudes and frequencies that may be ignored. The present invention also includes an enhanced tonal component determiner, which allows for the more accurate identification of significant tonal components.

Figure 1:
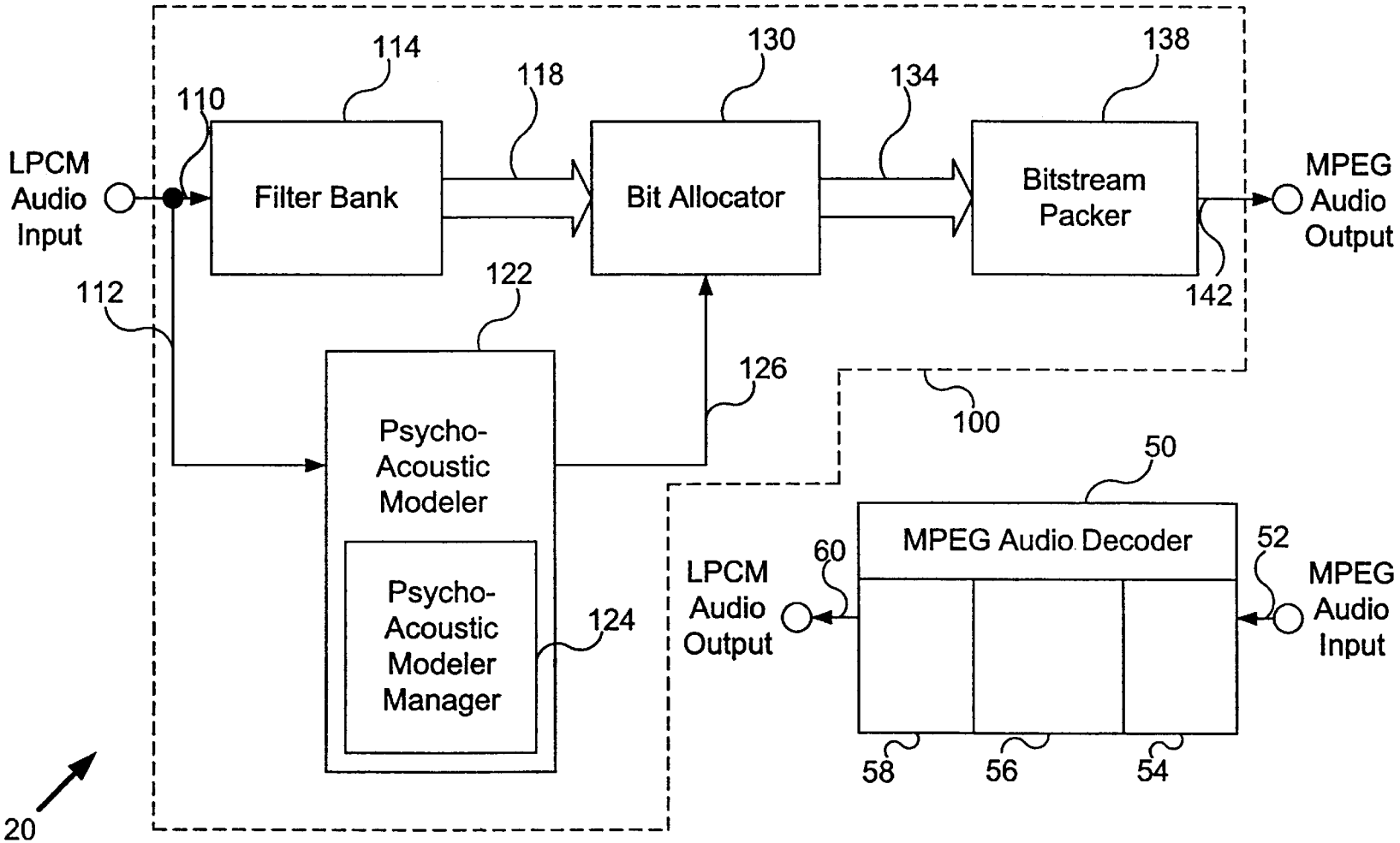
FIG. 1 is a block diagram of one embodiment of an MPEG audio encoding/decoding (CODEC) circuit, in accordance with the present invention.

Referring now to FIG. 1, a block diagram of one embodiment of an MPEG audio encoding/decoding (CODEC) circuit 20 is shown, in accordance with the present invention. MPEG CODEC 20 comprises MPEG audio decoder 50 and MPEG audio encoder 100. Traditionally MPEG audio decoder 50 comprises a bitstream unpacker 54, a frequency sample reconstructor 56, and a filter bank 58. In the preferred embodiment, MPEG audio encoder 100 comprises a filter bank 114, a bit allocator 130, a psycho-acoustic modeler 122, and a bitstream packer 138.

In the FIG. 1 embodiment, MPEG audio encoder 100 converts uncompressed linear pulse-code modulated (LPCM) audio into compressed MPEG audio. LPCM audio consists of time-domain sampled audio signals, and in the preferred embodiment consists of 16-bit digital samples arriving at a sample rate of 48 KHz. LPCM audio enters MPEG audio encoder 100 on LPCM audio signal line 110. Filter bank 114 converts the single LPCM bitstream into the frequency domain in a number of individual frequency sub-bands.

The frequency sub-bands approximate the 25 critical bands of psycho-acoustic theory. This theory notes how the human ear perceives frequencies in a non-linear manner. To more easily discuss phenomena concerning the non-linearly spaced critical bands, the unit of frequency denoted a "Bark" is used, where one Bark (named in honor of the acoustic physicist Barkhausen) equals the width of a critical band. For frequencies below 500 Hz, one Bark is approximately the frequency divided by 100. For frequencies above 500 Hz, one Bark is approximately 9+4 log(frequency/1000).

In the MPEG standard model, 32 sub-bands are selected to approximate the 25 critical bands. In other embodiments of digital audio encoding and decoding, differing numbers of sub-bands may be selected. Filter bank 114 preferably comprises a 512 tap finite-duration impulse response (FIR) filter. This FIR filter yields on digital sub-bands 118 an uncompressed representation of the digital audio in the frequency domain separated into the 32 distinct sub-bands.

Bit allocator 130 acts upon the uncompressed sub-bands by determining the number of bits per sub-band that will represent the signal in each sub-band. It is desired that bit allocator 130 allocate the minimum number of bits per sub-band necessary to accurately represent the signal in each sub-band.

To achieve this purpose, MPEG audio encoder 100 includes a psycho-acoustic modeler 122 which supplies information to bit allocator 130 regarding masking thresholds via threshold signal output line 126. These masking thresholds are further described below in conjunction with FIGS. 2 through 8 below. In the preferred embodiment of the present invention, psycho-acoustic modeler 122 comprises a software component called a psycho-acoustic modeler manager 124. When psycho-acoustic modeler manager 124 is executed it performs the functions of psycho-acoustic modeler 122.

After bit allocator 130 allocates the number of bits to each sub-band, each sub-band may be represented by fewer bits to advantageously compress the sub-bands. Bit allocator 130 then sends compressed sub-band audio 134 to bitstream packer 138, where the sub-band audio data is converted into MPEG audio format for transmission on MPEG compressed audio 142 signal line.

Figure 2:
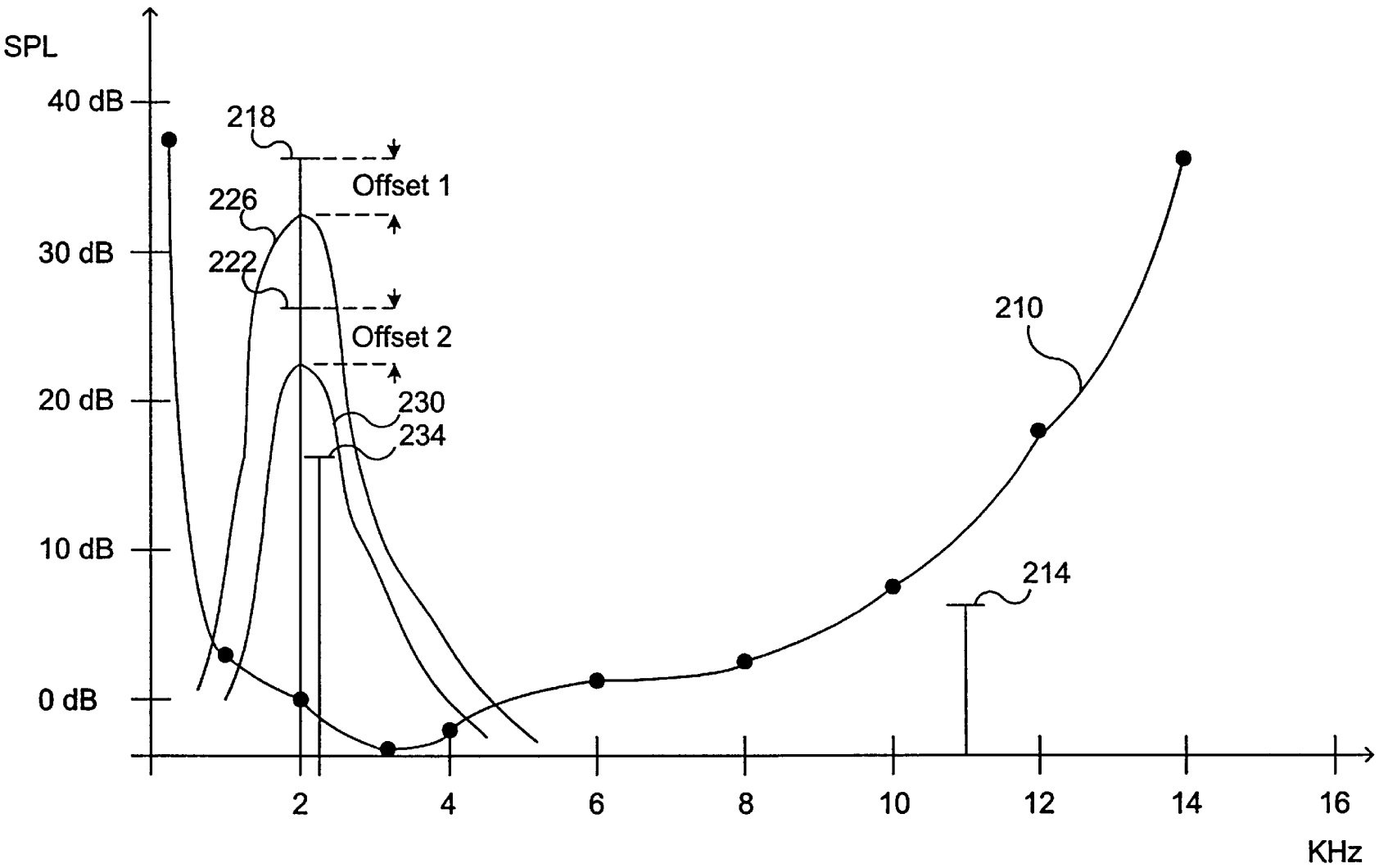
FIG. 2 is a graph showing basic psycho-acoustic concepts.

Referring now to FIG. 2, a graph illustrating basic psycho-acoustic concepts is shown. Frequency in kilohertz is displayed along the horizontal axis, and the sound pressure level (SPL) of various maskers is shown along the vertical axis. A curve called the absolute masking threshold 210 represents the SPL at differing frequencies below which an average human ear cannot perceive. For example, an 11 KHz tone of 10 dB 214 lies below the absolute masking threshold 210 and thus cannot be heard by the average human ear. Absolute masking threshold 210 exhibits the fact that the human ear is most sensitive in the "speech range" of from 1 KHz to 5 KHz, and is increasingly insensitive at the extreme bass and extreme treble ranges.

Additionally, tones may be rendered unperceivable by the presence of another, louder tone at an adjacent frequency. The 2 KHz tone at 40 dB 218 makes it impossible to hear the 2.25 KHz tone at 20 dB 234, even though 2.25 KHz tone at 20 dB 234 lies above the absolute masking threshold 210. This effect is termed tone masking.

The extent of tone masking is experimentally determined. Curves known as spread functions show the threshold below which adjacent tones cannot be perceived. In FIG. 2, a 2 KHz tone at 40 dB 218 is associated with spread function 226. Spread function 226 is a continuous curve with a maximum point below the SPL value of 2 KHz tone at 40 dB 218. The difference in SPL between the SPL of 2 KHz tone at 40 dB 218 and the maximum point of corresponding spread function 226 is termed the offset of spread function 226. The spread function will change as a function of SPL and frequency. As an example, 2 KHz tone at 30 dB 222 has associated spread function 230, with a differing shape compared with spread function 226.

In addition to masking caused by tones, noise signals having a finite bandwidth may also mask out nearby sounds.

For this reason the term masker will be used when necessary as a generic term encompassing both tone and noise sounds which have a masking effect. In general the effects are similar, and the following discussion may specify tone masking as an example. But it should be remembered that, unless otherwise specified, the effects discussed apply equally to noise sounds and the resulting noise masking.

The utility of the absolute masking threshold 210, and the spread functions 226 and 230, is in aiding bit allocator 130 to allocate bits to maximize both compression and fidelity. If the tones of FIG. 2 were required to be encoded by MPEG audio encoder 100, then allocating any bits to the sub-band containing 11 KHz tone of 10 dB 214 would be pointless, because 11 KHz tone of 10 dB 214 lies below absolute masking threshold 210 and would not be perceived by the human ear. Similarly allocating any bits to the sub-band containing 2.25 KHz tone of 20 dB 234 would be pointless because 2.25 KHz tone of 20 dB 234 lies below spread function 226 and would not be perceived by the human ear. Thus, knowledge about what may or may not be perceived by the human ear allows efficient bit allocation and resulting data compression without sacrificing fidelity.

Figure 3A:
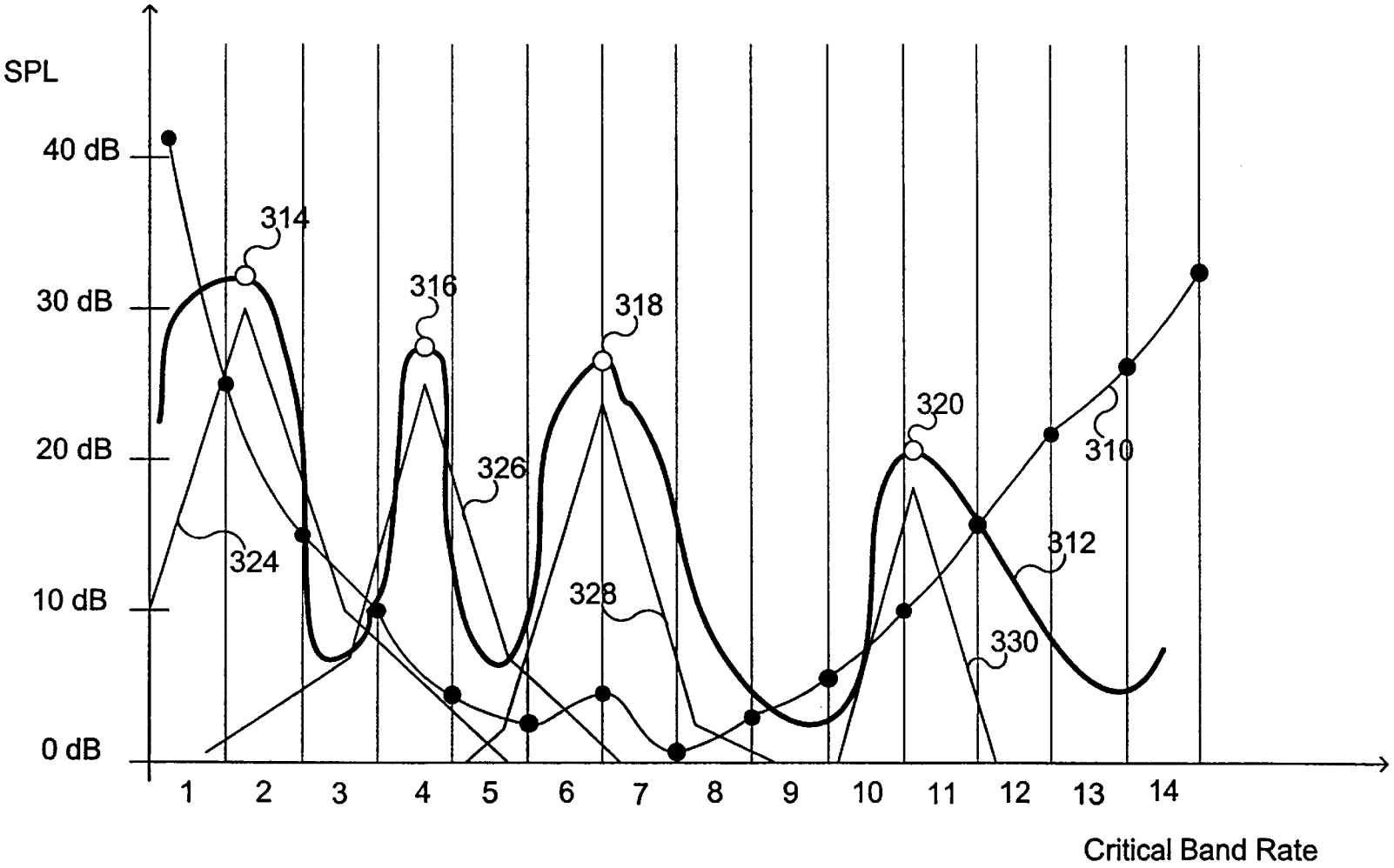
FIGS. 3A and 3B are graphs showing the derivation of the global masking threshold, in accordance with the present invention.
Figure 3B:
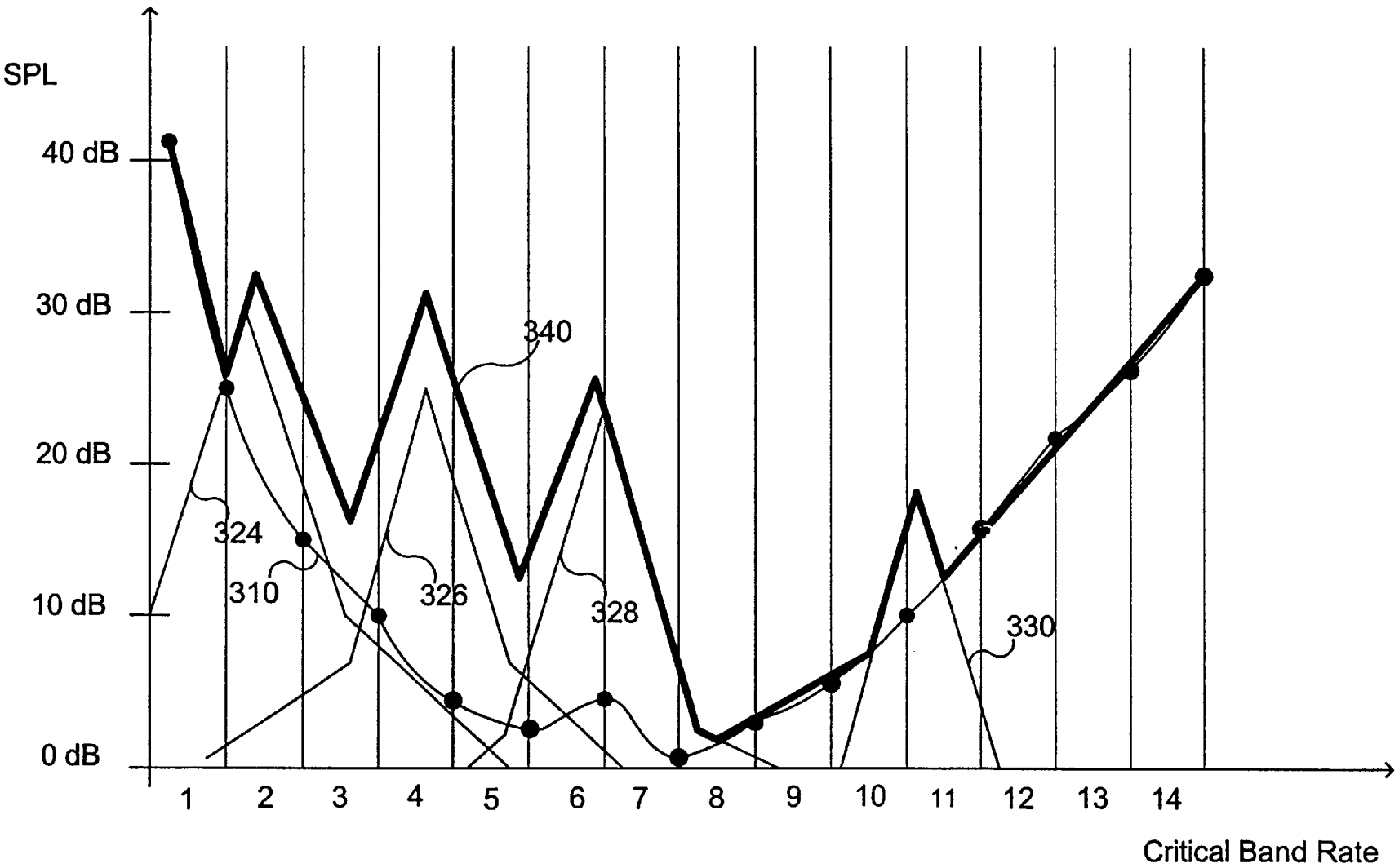

Referring now to FIGS. 3A and 3B, graphs illustrating the derivation of the global masking threshold are shown, in accordance with the present invention. The frequency allocation of the critical bands is displayed across the horizontal axis measured in Barks, and the sound pressure level (SPL) of various maskers is shown along the vertical axis. For the purpose of illustrating the present invention, FIGS. 3A, 3B, 4, and 5 only show 14 critical bands. However, in reality there are 25 critical bands measured in psycho-acoustic theory. Similarly, for the purpose of illustration, the frequency domain representation 312 is shown in a very simplified form as a continuous curve with few minimum and maximum points. In actual use, the frequency domain representation 312 would typically be a series of disconnected points with many more minimum and maximum values.

In the preferred embodiment, the psycho-acoustic modeler 122 comprises a digital signal processing (DSP) microprocessor (not shown in FIG. 1). In alternate embodiments other digital processors may be used. The psycho-acoustic modeler manager 124 of psycho-acoustic modeler 122 runs on the DSP. The psycho-acoustic modeler manager 124 converts the LPCM audio from the original time domain to the frequency domain by performing a fast-Fourier transform (FFT) on the LPCM audio. In alternate embodiments, other methods may be used to derive the frequency domain representation of the LPCM audio. The frequency domain representation 312 of the LPCM audio is shown as a curve on FIG. 3A to represent the power spectral density (PSD) of the LPCM audio.

The psycho-acoustic modeler manager 124 then determines the tonal components for masking threshold computation by searching for the maximum points of frequency domain representation 312. The process of determining the tonal components is described in detail in conjunction with FIG. 8 below. In the FIG. 3A example, determining the maximum points of frequency domain representation 312 yields first tonal component 314, second tonal component 316, and third tonal component 318. Noise components are determined differently. After the tonal components are identified, the remaining signals in each critical band are integrated to represent a noise component inside the critical band. For the purpose of illustration, FIG. 3A assumes sufficient non-tonal signal strength is found in critical band 11, and identifies noise component 320. The psycho-acoustic modeler manager 124 next compares the identified masking components with the absolute masking threshold 310.

Next psycho-acoustic modeler manager 124 eliminates any smaller tonal components within a range of 0.5 Bark from each tonal component (not shown in the FIG. 3A example). This step is known as decimation. Psycho-acoustic modeler manager 124 then determines the spread functions corresponding to the masking components 314, 316, 318, and 320. The spread functions derived from experiment are complex curves. In the preferred embodiment, the spread functions are represented for memory storage and computational efficiency by a four segment piecewise linear approximation. These four segment piecewise linear approximations may be characterized by an offset and by the slopes of the segments. In the FIG. 3A example, masking components 314, 316, 318, and 320 are associated with piecewise linear spread functions 324, 326, 328, and 330, respectively.

Starting with the piecewise linear spread functions 324, 326, 328, and 330 of FIG. 3A, FIG. 3B shows the derivation of the global masking threshold 340. In FIG. 3B, the psycho-acoustic modeler manager 124 adds the values of the individual piecewise linear spread functions 324, 326, 328, and 330 together. The psycho-acoustic modeler manager 124 compares the resulting sum with absolute masking threshold 310, and selects the greater of the sum and the absolute masking threshold 310 as the global masking threshold 340.

Figure 4:
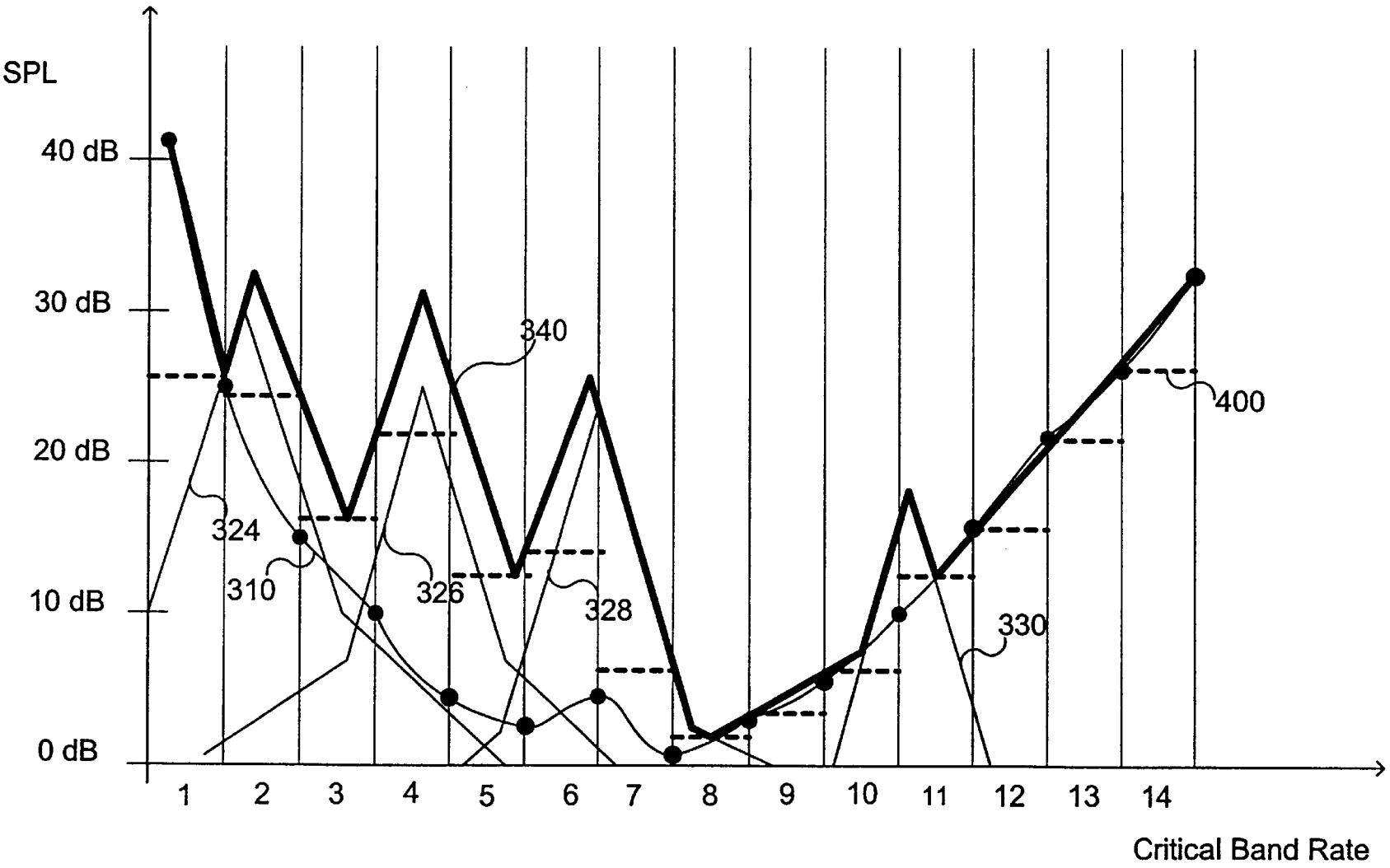
FIG. 4 is a graph showing the derivation of the minimum masking threshold, in accordance with the present invention.

Referring now to FIG. 4, a graph illustrating the derivation of the minimum masking threshold is shown, in accordance with the present invention. The frequency allocation of the critical bands is displayed across the horizontal axis measured in Barks, and the sound pressure level (SPL) of various maskers is shown along the vertical axis. Psycho-acoustic modeler manager 124 examines the global masking threshold 340 in each critical band. The psycho-acoustic modeler manager 124 determines the minimum value of the global masking threshold 340 in each critical band. These minimum values determine a new step function, called the minimum masking threshold 400, whose values are the minimum values of the global masking threshold 340 in each critical band. Minimum masking threshold 400 serves as the mask-to-noise ratio (MNR). Once minimum masking threshold 400 is determined, psycho-acoustic modeler manager 124 transfers minimum masking threshold 400 via threshold signal output 126 for use by bit allocator 130.

Figure 5:
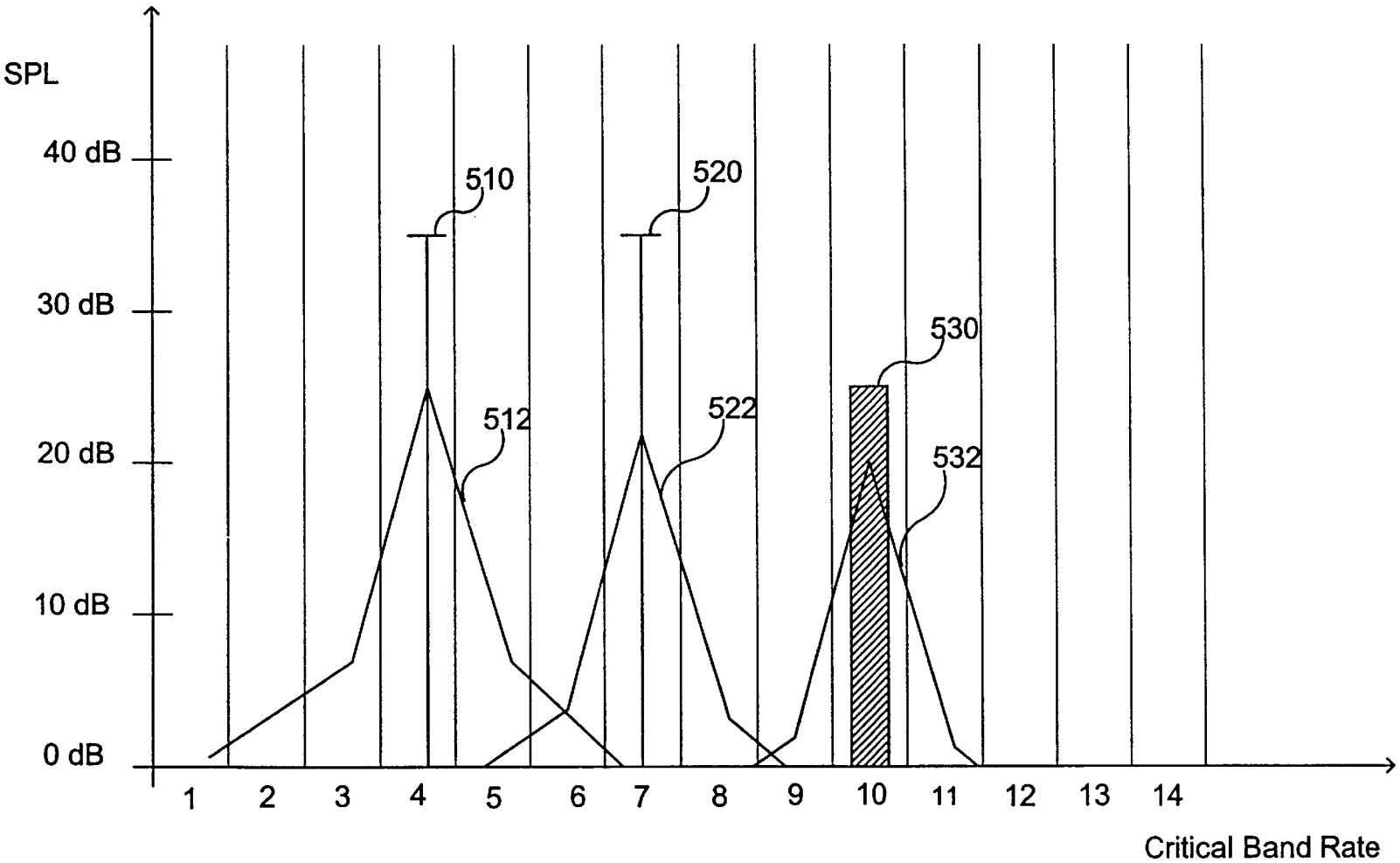
FIG. 5 is a chart showing the piecewise linear spread functions for tone and noise masking, in accordance with the present invention.

Referring now to FIG. 5, a chart shows the piecewise linear approximations to the spread functions for tone and noise masking, in accordance with the present invention. The frequency allocation of the critical bands is displayed across the horizontal axis measured in Barks, and the sound pressure level (SPL) of various maskers is shown along the vertical axis. In FIG. 5, two individual tones having an SPL of 35 dB are shown as tone 510 and tone 520. The shapes of the corresponding respective spread functions, spread function 512 and spread function 522, are essentially the same because tones 510 and 520 are of equal SPL. The shapes of spread functions are primarily a function of the SPL of the tone. Further details concerning the shape of spread functions are presented below in conjunction with FIG. 7. However, because tone 520 is at a higher frequency than tone 510, spread function 522 is offset from tone 520 by a greater amount than spread function 512 is offset from tone 510. In general, the offset of a spread function from the corresponding tone is a function of frequency called the mask index. Further details concerning the mask index are given below in conjunction with FIG. 6.

Noise signals of a finite bandwidth also contribute to masking. In general, a noise signal of a given SPL generates more masking effect than a tone of the same SPL. As shown in FIG. 5, noise signal 530 corresponds to spread function 532. Spread function 532 has a much smaller offset than a spread function for a tone of the same SPL. For this reason, the mask index functions are different for tones and noise signals. However, the shape of the spread functions for tones and noise signals are essentially equal.

Figure 6:
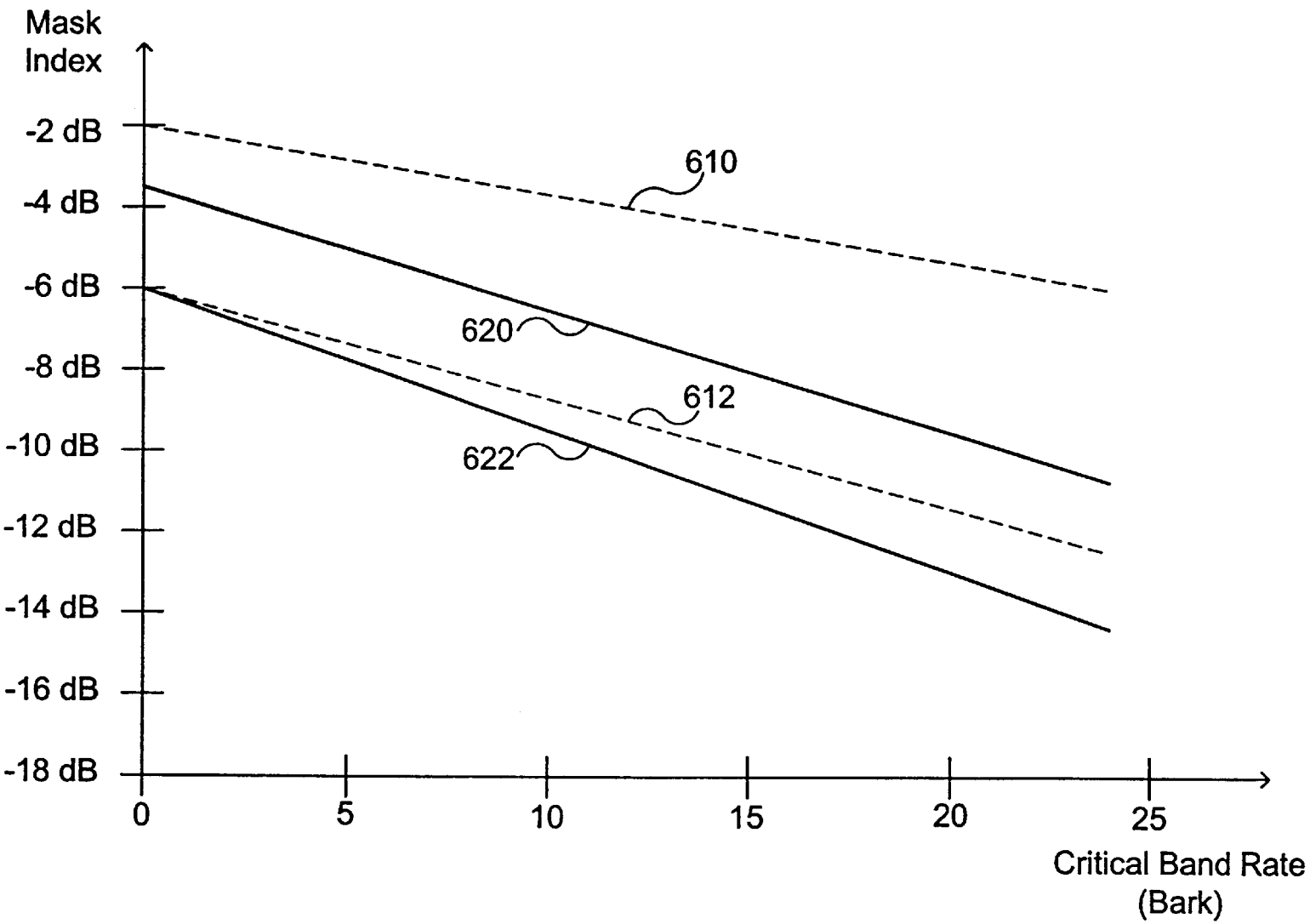
FIG. 6 is a chart showing one embodiment of a mask index function, in accordance with the present invention.

Referring now to FIG. 6, a chart shows one embodiment of a mask index function, in accordance with the present invention. The frequency allocation of the critical bands is displayed across the horizontal axis measured in Barks, and the mask index function is shown along the vertical axis measured in dB. FIG. 6 details the preferred mask index utilized in the present invention. Traditionally, noise mask index 610 and tone mask index 612 have been utilized in MPEG applications. In the preferred embodiment of the present invention, different and refined mask indices are employed.

In the preferred embodiment, psycho-acoustic modeler manager 124 uses noise mask index 620. Noise mask index 620 is substantially equal to a value between −3 dB and −4 dB in the first critical band. Noise mask index 620 then decreases at a rate substantially equal to 0.3 dB/Bark. The effect of noise mask index 620 is that the masking due to noise signals is less, and the masking is reduced to a greater degree at higher frequencies, than in traditional noise mask index 610. Using similar initial offsets and slopes to produce a noise mask index is also within the scope of the present invention.

Figure 7:
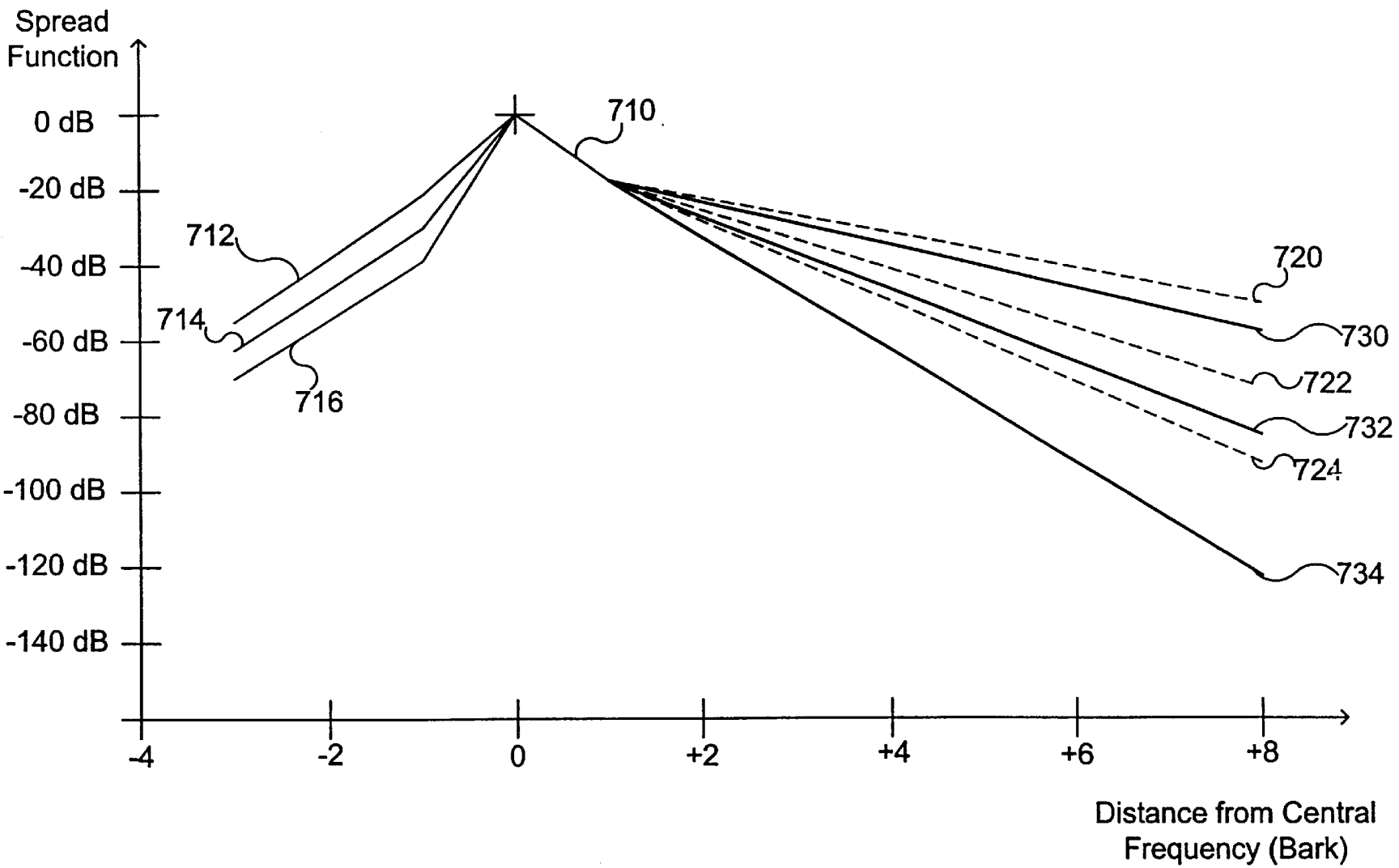
FIG. 7 is a chart showing one embodiment of an improved piecewise linear spread function, in accordance with the present invention.

Also in the preferred embodiment, psycho-acoustic modeler manager 124 uses tone mask index 622. Tone mask index 622 is substantially equal to −6 dB in the first critical band. Tone mask index 622 then decreases at a rate substantially equal to 0.35 dB/Bark. As with noise mask index 620, tone mask index 622 has the effect that masking is reduced to a greater degree at higher frequencies than in traditional tone mask 612. Again, using similar initial offsets and slopes to produce a tone mask index is also within the scope of the present invention Referring now to FIG. 7, a chart shows one embodiment of an improved piecewise linear spread function, in accordance with the present invention. The distance in frequency from the central frequency of a masking component is shown across the horizontal axis measured in Barks, and the values of spread functions are shown along the vertical axis measured in dB. FIG. 7 shows a set of four segment piecewise linear approximations to the experimentally determined spread functions of psycho-acoustic theory. The different members of the approximation set correspond to the spread functions of maskers at different SPL values. Spread function 712 corresponds to a masker with an SPL value of 80 dB, spread function 714 corresponds to a masker with an SPL value of 60 dB, and spread function 716 corresponds to a masker with an SPL value of 40 dB. In each case, the spread function in the range from the central frequency at 0 Barks to 1 Bark higher is a segment 710 decreasing at a rate of −17 dB/Bark. Traditionally, in the range from 1 Bark to approximately 8 Barks above the central frequency there were differing slopes for different SPL values. For example, segment 720 was used for maskers with 80 dB SPL, and has a slope of −5 dB/Bark. Segment 722 was used for maskers with 60 dB SPL, and has a slope of −8 dB/Bark. Segment 724 was used for maskers with 40 dB SPL, and has a slope of −11 dB/Bark.

The preferred embodiment of the present invention utilizes a new set of values for the slopes of the spread functions in the range from 1 Bark to approximately 8 Barks above the central frequency. In the preferred embodiment, segment 730 replaces the use of segment 720 for use with maskers of 80 dB SPL. Segment 730 has a slope substantially equal to −7 dB/Bark. In the preferred embodiment, segment 732 replaces the use of segment 722 for use with maskers of 60 dB SPL. Segment 732 has a slope substantially equal to −10 dB/Bark. Finally, in the preferred embodiment, segment 734 replaces the use of segment 722 for use with maskers of 40 dB SPL. Segment 734 has a slope substantially equal to −14 dB/Bark.

In the preferred embodiment of the present invention, psycho-acoustic modeler manager 124 utilizes the segments 730, 732, and 734 segments in the piecewise linear approximations to the spread functions in psycho-acoustic modeler manager 124 calculations. Psycho-acoustic modeler manager 124 further utilizes the mask indices 620 and 622 of FIG. 6 to provide improved offset values when used in conjunction with segments 730, 732, and 734 in the piecewise linear approximations to the spread functions for psycho-acoustic modeler manager 124 calculations resulting in the derivation of the minimum masking threshold 400, as discussed in conjunction with FIGS. 3A, 3B, and 4 above. When the minimum masking threshold 400 is calculated in this manner, the bit allocator 130 may thereby allocate the bits in a manner that will result in improved fidelity in the encoded MPEG audio.

Figure 8:
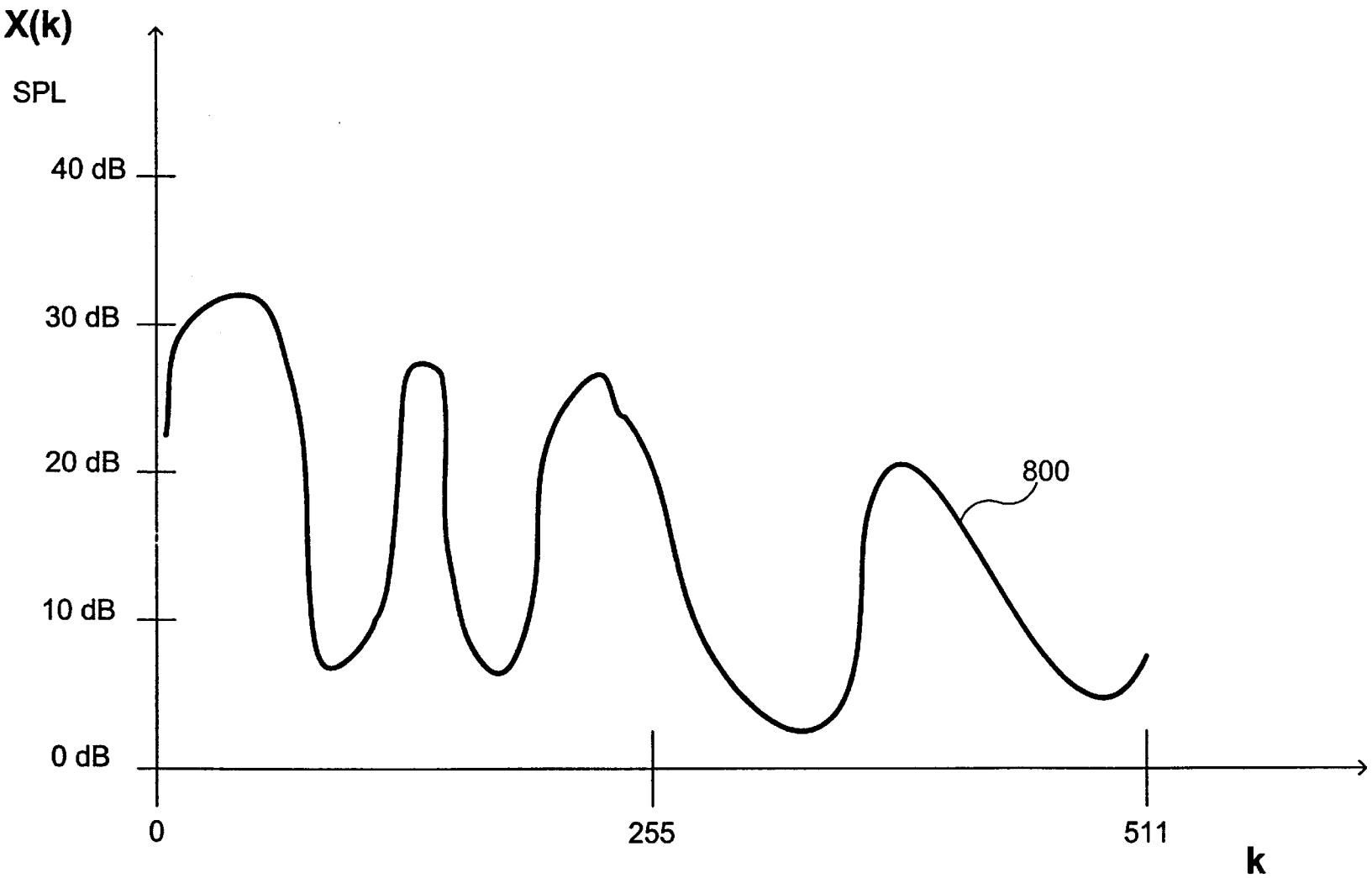
FIG. 8 is a diagram showing one embodiment of an improved method of tonal component determination, in accordance with the present invention.

Referring now to FIG. 8, a diagram shows one embodiment of an improved method of tonal component determination, in accordance with the present invention. Here the 512 discrete values of the frequency domain samples are shown across the horizontal axis by sample number, and the SPL of the function X(k) is shown along the vertical axis measured in dB. As in the case of FIG. 3A, for the purpose of illustration an exemplary frequency domain representation 800 is shown in a very simplified form as a continuous curve with few minimum and maximum points. In the case of FIG. 3A, the masking components are tonal components 314, 316, 318, and noise component 320. In actual use, the frequency domain representation 800 would typically, for example, be a series of disconnected points with many more minimum and maximum values. In the preferred embodiment, the frequency domain representation 800 of the LPCM audio is derived by a 1024 point FFT. The frequency domain representation 800 is a function X(k) where the discrete-valued independent variable k represents frequency. In the embodiment shown in FIG. 8, a k value of 0 represents 0 frequency, and a k value of 511 represents 24 KHz.

In order to determine the tonal components of the LPCM audio, for each value of k the psycho-acoustic modeler 122 examines the values of X (k+j) for neighboring points k+j. If the value of X(k)−X(k+j) is greater than or equal to 7 dB for all neighboring points k+j, then X(k) is added to the list of masking components. The number of values of j to use in the above determination varies with frequency, with more values being used at higher frequencies. Traditionally, the values of j to use as a function of the frequency k has been as given in Table I below. Notice that the values −1, 0, and 1 are excluded from the values of j.

TABLE I

| Values of j | Range of k |
|---|---|
| −2, 2 | 2 < k < 63 |
| −3, −2, 2, 3 | 62 < k < 127 |

TABLE I-continued

| Values of j | Range of k |
|---|---|
| −6, . . . −2, 2, . . . 6 | 126 < k < 255 |
| −12, . . . −2, 2, . . . 12 | 254 < k < 511 |

In the preferred embodiment of the present invention, an improved set of values of j and ranges of k are used. This improved set is given in Table II below. Again notice that the values −1, 0, and 1 are excluded from the values of j.

TABLE II

| Values of j | Range of k |
|---|---|
| −2, 2 | 2 < k < 63 |
| −3, −2, 2, 3 | 62 < k < 127 |
| −4, . . . −2, 2, . . . 4 | 126 < k < 255 |
| −5, . . . −2, 2, . . . 5 | 254 < k < 384 |
| −12, . . . −2, 2, . . . 12 | 383 < k < 511 |

The values for j as given in Table II allow more accuracy in the determination of the masking components in the psycho-acoustic modeler 122.

Figure 9:
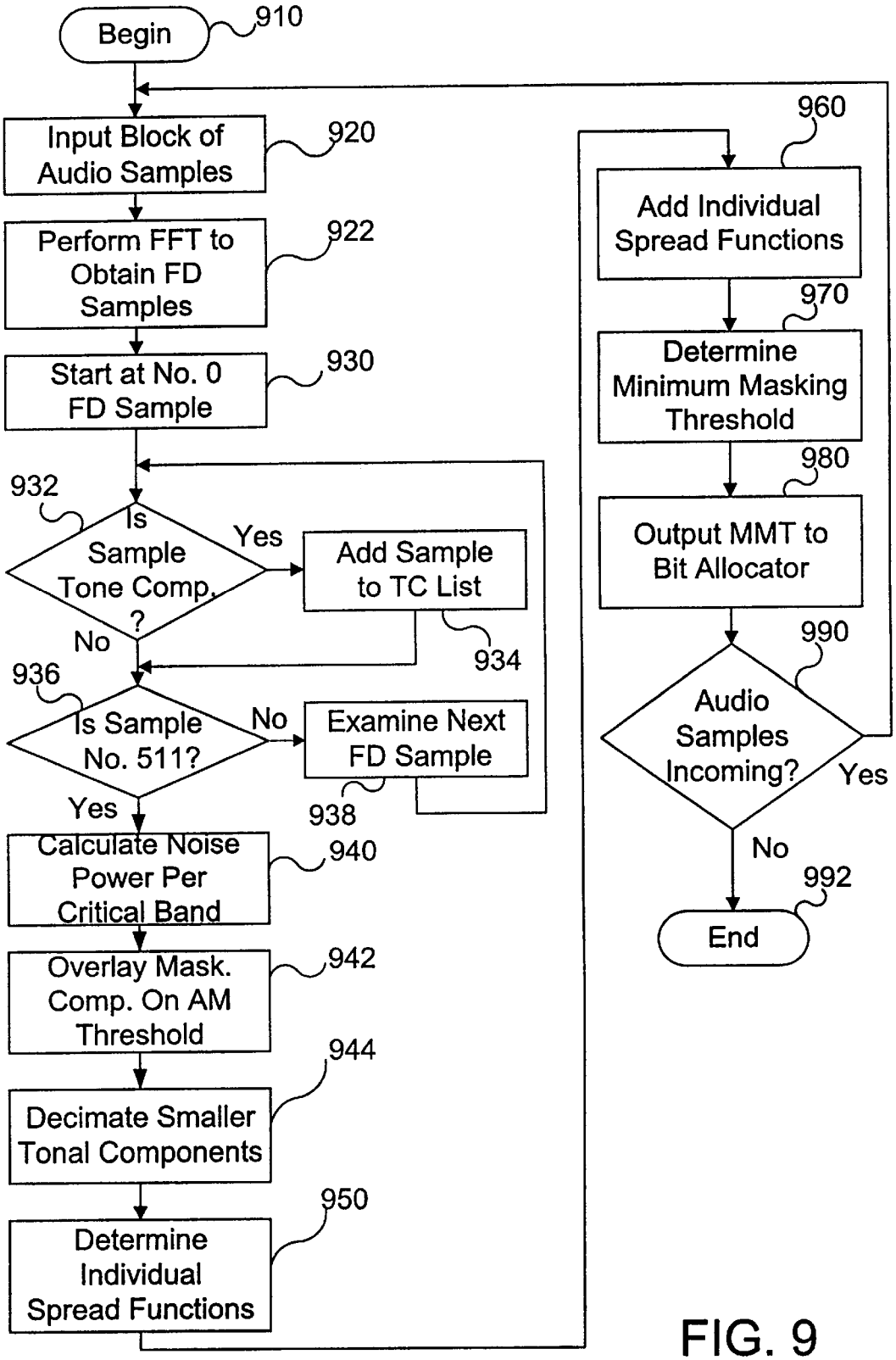
FIG. 9 is a flowchart of preferred method steps for implementing a psycho-acoustic modeler, in accordance with the present invention.

Referring now to FIG. 9, a flowchart of preferred method steps for implementing a psycho-acoustic modeler is shown, in accordance with the present invention. In step 910, the process is initiated by the introduction of LPCM digital audio to MPEG audio encoder 100. Then, in step 920, psycho-acoustic modeler manager 124 begins the process of masking determination by inputting a block of digital audio samples. Next, in step 922, psycho-acoustic modeler manager 124 converts the LPCM digital audio into a set of 512 frequency domain samples by executing a FFT on the block of digital audio samples.

In steps 930 through 938, psycho-acoustic modeler manager 124 determines which frequency domain samples in the set of 512 frequency domain samples are to be considered tonal components. This begins in step 930, where the frequency domain sample to be tested for inclusion in the list of tonal components (called the sample under test) is initially set at sample number 0. Then, in step 932, the neighboring samples are tested to determine if they are all at least 7 dB lower than the current sample under test. (In step 932, the determination of whether a sample is a neighboring sample utilizes the range values of Table II above.)

If, in step 932, the sample under test is 7 dB higher than the neighboring samples, then the sample under test is deemed a tonal component, and step 932 exits via the Yes branch. Then, in step 934, the sample under test is entered on the list of tonal components. Conversely, if the sample under test is not deemed a tonal component, then step 932 exits via the No branch. In both cases, psycho-acoustic modeler manager 124 advances to step 936, where psycho-acoustic modeler manager 124 determines whether the sample under test is the last sample in the set of frequency domain samples (sample number 511). If the sample under test is not the last sample, then, in step 938, the next higher numbered sample is set as the sample under test, and the FIG. 9 process returns to step 932. If the sample under test is the last sample (sample number 511), then the determination of the tonal components is complete and step 936 then exits via the Yes branch.

In step 940, psycho-acoustic modeler manager 124 integrates the signal power levels within each critical band, excluding the components determined in steps 930 through 938 above. This identifies noise components. In step 942, psycho-acoustic modeler manager 124 overlays both tone and noise masking components on a stored copy of the absolute masking threshold 210. In step 944, psycho-acoustic modeler manager 124 deletes smaller tonal components located within 0.5 Bark of each tonal component. Then, in step 950, psycho-acoustic modeler manager 124 produces the piecewise linear spread functions as discussed above in conjunction with FIGS. 5, 6, and 7. In step 960, psycho-acoustic modeler manager 124 numerically sums together the piecewise linear spread functions of step 950 to produce the global masking threshold 340. Then, in step 970, psycho-acoustic modeler manager 124 examines the global masking threshold 340 in each critical band and thereby produces the minimum masking threshold 400.

In step 980, the minimum masking threshold 400 is sent to bit allocator 130 via threshold signal output line 126 for use by bit allocator 130 in determining the signal-to-masking ratio (SMR). Bit allocator 130 uses the SMR in allocating bits. Psycho-acoustic modeler manager 124 then determines, in step 990, whether additional LPCM audio samples are arriving. If so, then step 990 exits via the Yes branch, and the entire FIG. 9 process repeats. Conversely, if no more LPCM audio samples are arriving, then step 990 exits via the No branch, and the FIG. 9 process terminates in step 992.

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A psycho-acoustic modeler, comprising:

a psycho-acoustic modeler manager, including a masking component determiner configured to determine masking components from data samples; and a spread function generator configured to determine masking contributions of said masking components, wherein said masking contributions include at least one piecewise linear spread function that is offset in amplitude from a corresponding masking component by a tone mask index.

2. The modeler of claim 1 wherein said at least one piecewise linear spread function has an upper segment extending from substantially 1 Bark above to substantially 8 Barks above a frequency of a corresponding masking component.

3. The modeler of claim 2 wherein said upper segment has a slope of −7 dB/Bark when said corresponding masking component has a sound pressure level of 80 dB.

4. The modeler of claim 2 wherein said upper segment has a slope of −10 dB/Bark when said corresponding masking component has a sound pressure level of 60 dB.

5. The modeler of claim 2 wherein said upper segment has a slope of −14 dB/Bark when said corresponding masking component has a sound pressure level of 40 dB.

6. The modeler of claim 1 wherein said tone mask index is a linear function with a slope of −0.35 dB/Bark.

7. The modeler of claim 1 wherein said at least one piecewise linear spread function is offset in amplitude from a corresponding masking component by a noise mask index.

8. The modeler of claim 7 wherein said noise mask index has an initial offset of between 3 dB and 4 dB in a first critical band.

9. The modeler of claim 7 wherein said noise mask index is a linear function with a slope of −0.3 dB/Bark.

10. The modeler of claim 1 wherein said data samples are frequency domain samples.

11. The modeler of claim 10 wherein said frequency domain samples are numbered 0 through 511.

12. The modeler of claim 11 wherein said masking component determiner includes a tonal component determiner.

13. The modeler of claim 12 wherein said tonal component determiner tests 6 neighboring samples for said frequency domain samples numbered 127 through 254.

14. The modeler of claim 12 wherein said tonal component determiner tests 8 neighboring samples for said frequency domain samples numbered 255 through 383.

15. The modeler of claim 12 wherein said masking component determiner tests 22 neighboring samples for said frequency domain samples numbered 384 through 511.

16. A method for providing psycho-acoustic information, comprising:

determining masking components from data samples; and determining masking contributions of said masking components, wherein said masking contributions include at least one piecewise linear spread function that is offset in amplitude from a corresponding masking component by a tone mask index.

17. The method of claim 16 wherein said at least one piecewise linear spread function has an upper segment extending from substantially 1 Bark above to substantially 8 Barks above a frequency of a corresponding masking component.

18. The method of claim 17 wherein said upper segment has a slope of −7 dB/Bark when said corresponding masking component has a sound pressure level of 80 dB.

19. The method of claim 17 wherein said upper segment has a slope of −10 dB/Bark when said corresponding masking component has a sound pressure level of 60 dB.

20. The method of claim 17 wherein said upper segment has a slope of −14 dB/Bark when said corresponding masking component has a sound pressure level of 40 dB.

21. The method of claim 16 wherein said tone mask index is a linear function with a slope of −0.35 dB/Bark.

22. The method of claim 16 wherein said at least one piecewise linear spread function is offset in amplitude from a corresponding masking component by a noise mask index.

23. The method of claim 22 wherein said noise mask index has an initial offset of between 3 dB and 4 dB in a first critical band.

24. The method of claim 22 wherein said noise mask index is a linear function with a slope of −0.3 dB/Bark.

25. The method of claim 16 wherein said data samples are frequency domain samples.

26. The method of claim 25 wherein said frequency domain samples are numbered 0 through 511.

27. The method of claim 26 wherein said step of determining masking components includes a step of determining tonal components.

28. The method of claim 27 wherein said step of determining tonal components tests 6 neighboring samples for said frequency domain samples numbered 127 through 254.

29. The method of claim 27 wherein said step of determining tonal components tests 8 neighboring samples for said frequency domain samples numbered 255 through 383.

30. The method of claim 27 wherein said step of determining tonal components tests 22 neighboring samples for said frequency domain samples numbered 384 through 511.

31. A computer-readable medium comprising program instructions for providing psycho-acoustic information, by performing the steps of:

determining masking components from data samples; and determining masking contributions of said masking components, wherein said masking contributions include at least one piecewise linear spread function that is offset in amplitude from a corresponding masking component by a tone mask index.

32. A device for providing psycho-acoustic information, comprising:

means for determining masking components from data samples; and means for determining masking contributions of said masking components, wherein said masking contributions include at least one piecewise linear spread function that is offset in amplitude from a corresponding masking component by a tone mask index.

33. The device of claim 32 wherein said means for determining masking components includes means for determining tonal components.

34. The device of claim 33 wherein said means for determining tonal components includes means for testing neighboring frequency domain samples within said data samples.

35. The device of claim 32 wherein said means for determining masking contributions includes means for determining offsets of said masking contributions.

36. The device of claim 32 wherein said means for determining masking contributions includes means for determining shapes of said masking contributions.

37. The device of claim 36 wherein said means for determining the shapes of said masking contributions includes means for determining the slopes of said shapes of said masking contributions.

38. A system for processing digital audio, comprising:

a CODEC including
- a bit allocator and
- a psycho-acoustic modeler having
  - a data processor, and
  - a psycho-acoustic modeler manager with
    - a masking component determiner configured to determine masking components from data samples, and
    - a spread function generator configured to determine masking contributions of said masking components, wherein said masking contributions include at least one piecewise linear spread function that is offset in amplitude from a corresponding masking component by a tone mask index.

39. The system of claim 38, wherein said masking component determiner includes means for testing neighboring frequency domain samples.

40. The system of claim 38, wherein spread function generator includes means for determining offsets of said masking contributions.

41. The system of claim 38, wherein spread function generator includes means for determining shapes of said masking contributions.

* * * * *